US005100533A

United States Patent [19]

Le et al.

[11] Patent Number: 5,100,533

[45] Date of Patent: * Mar. 31, 1992

[54] PROCESS FOR PRODUCTION OF ISO-OLEFIN AND ETHER

[75] Inventors: Quang N. Le, Cherry Hill; Hartley Owen, Belle Mead, both of N.J.; Paul H. Schipper, Wilmington, Del.

[73] Assignee: Mobil Oil Corporation, Fairfax, Va.

[ * ] Notice: The portion of the term of this patent subsequent to Nov. 13, 2007 has been disclaimed.

[21] Appl. No.: 607,952

[22] Filed: Nov. 1, 1990

Related U.S. Application Data

[63] Continuation-in-part of Ser. No. 442,806, Jul. 5, 1990, Pat. No. 4,969,987.

[51] Int. Cl.[5] ..... C10G 11/05

[52] U.S. Cl. ..... 208/67; 208/120; 585/324; 585/649; 585/653; 568/697

[58] Field of Search ..... 258/49, 67, 120; 585/649, 653, 324; 568/697

[56] References Cited

U.S. PATENT DOCUMENTS 4,826,667 5/1989 Zones et al. ..... 502/64
4,836,909 6/1989 Matsuo et al. ..... 208/67
4,911,823 3/1990 Chen et al. ..... 208/49
4,954,325 9/1990 Rubin et al. ..... 502/64
4,969,987 11/1990 Le et al. ..... 208/120
4,980,053 12/1990 Li et al. ..... 585/653

FOREIGN PATENT DOCUMENTS 0347003 12/1989 European Pat. Off. ..... 208/120

*Primary Examiner*—Anthony McFarlane
*Attorney, Agent, or Firm*—Alexander J. McKillop; Charles J. Speciale; L. G. Wise

[57] ABSTRACT

Process and apparatus for upgrading paraffinic naphtha to high octane fuel by contacting a fresh virgin naphtha feedstock stream medium pore acid cracking catalyst comprising MCM-22 zeolite under low pressure selective cracking conditions effective to produce increased yield of total C4–C5 branched aliphatic hydrocarbhons. The preferred feedstock is straight run naptha containing C7+ alkanes, at least 15 wt % C7+ cycloaliphatic hydrocarbons and less than 20% aromatics, which can be converted with a fluidized bed catalyst in a vertical riser reactor during a short contact period.

The isoalkene products of cracking are etherified to provide high octane fuel components.

31 Claims, 1 Drawing Sheet

PROCESS FOR PRODUCTION OF ISO-OLEFIN AND ETHER

REFERENCE TO COPENDING APPLICATION

This application is a continuation-in-part of U.S. patent application Ser. No. 07,442,806 filed 5 July 1990 now U.S. Pat. No. 4,969,987 incorporated herein by reference.

BACKGROUND OF THE INVENTION

This invention relates to production of high octane fuel from naphtha by hydrocarbon cracking and etherification. In particular, it relates to methods and reactor systems for cracking $C_7+$ paraffinic and naphthenic feedstocks, such as naphthenic petroleum fractions, under selective reaction conditions to produce etherifiable isoalkenes.

There has been considerable development of processes for synthesizing alkyl tertiary-alkyl ethers as octane boosters in place of conventional lead additives in gasoline. The etherification processes for the production of methyl tertiary alkyl ethers, in particular methyl t-butyl ether (MTBE) and t-amyl methyl ether (TAME) have been the focus of considerable research. It is known that isobutylene (i-butene) and other isoalkenes (branched olefins) produced by hydrocarbon cracking may be reacted with methanol, ethanol, isopropanol and other lower aliphatic primary and secondary alcohols over an acidic catalyst to provide tertiary ethers. Methanol is considered the most important $C_1$–$C_4$ oxygenate feedstock because of its widespread availability and low cost. Therefore, primary emphasis herein is placed on MTBE and TAME and cracking processes for making isobutylene and isoamylene reactants for etherification.

SUMMARY OF THE INVENTION

A novel process and operating technique has been found for upgrading paraffinic and naphthenic naphtha to high octane fuel. The primary reaction for conversion of naphtha is effected by contacting a fresh naphtha feedstock stream containing a major amount of C7+ alkanes and naphthenes with medium pore acid cracking catalyst under low pressure selective cracking conditions effective to produce at least 10 wt% selectivity C4–C5 isoalkene. Selectivity to desirable tertiary aliphatic hydrocarbons is enhanced by employing partial conversion conditions, preferably a contact time of about 0.5 to less than 10 seconds. The primary short contact time reaction step is followed by separating the cracking effluent to obtain a light olefinic fraction rich in C4–C5 isoalkene and a C6+ liquid fraction of enhanced octane value. By etherifying the C4–C5 isoalkene fraction catalytically with lower alcohol (ie, C1–C4 aliphatic alcohol), a valuable tertiary-alkyl ether product is made. Preferrably, the cracking catalyst is a metallosilicate having the structure of MCM-22, substantially free of hydrogenation-dehydrogenation metal components and having acid cracking activity less than 15 (alpha value) to enhance octane improvement and optimize selectivity of intermediate C4–C5 tertiary aliphatic hydrocarbons.

MCM-22 cracking catalysis is characterized by low yields of undesirable normal C3–C5 alkanes and substantially increased yields of isobutane and isopentanes, which can be further upgraded to high octane fuel components by conventional HF alkylation or dehydrogenated to the corresponding isoalkene.

These and other objects and features of the invention will be understood from the following description and in the drawing.

DRAWING

FIG. 1 of the drawing is a schematic flow sheet depicting a multireactor cracking and etherification system depicting the present invention;

DETAILED DESCRIPTION

Figure 1:
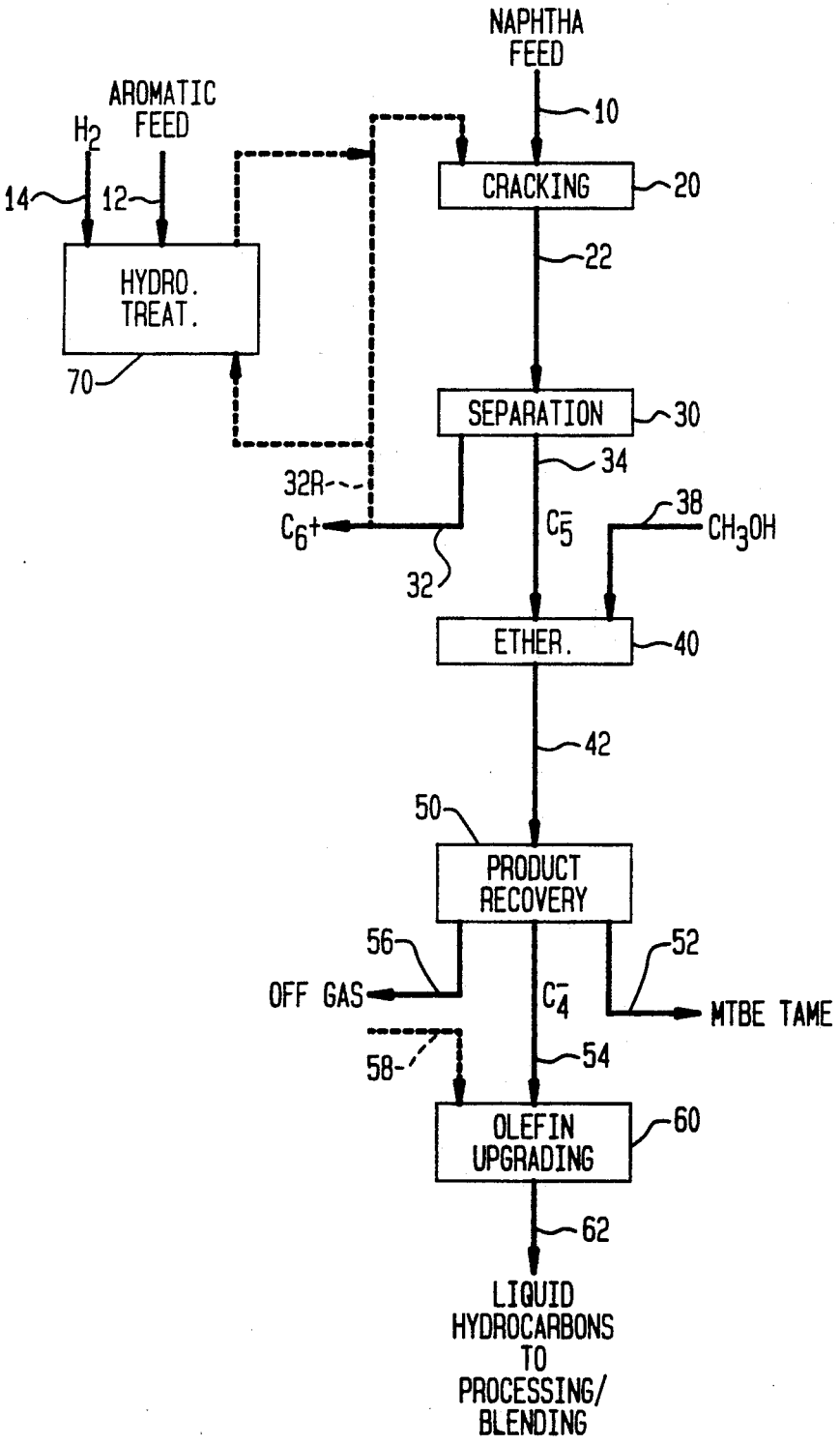

Typical naphtha feedstock materials for selective cracking are produced in petroleum refineries by distillation of crude oil. Typical straight run naphtha fresh feedstock usually contains at least 15 wt% (preferably about 20 to 50 wt%) C7–C12 normal and branched alkanes, at least 15 wt% (preferably about 20 to 50%) C7+ cycloaliphatic (i.e., naphthene) hydrocarbons, and 1 to 40% (preferrably less than 20%) aromatics. The C7–C12 hydrocarbons have a normal boiling range of about 65° to 175° C. In addition to virgin naphtha, the process can utilize various paraffin containing feedstocks, such as derived from hydrocracking, cracked FCC naphtha, hydrocracked naphtha, coker naphtha, visbreaker naphtha and reformer extraction (Udex) raffinate, including mixtures thereof. For purposes of explaining the invention, discussion is directly mainly to virgin naphtha and methanol feedstock materials.

Referring to FIG. 1 of the drawing the operational sequence for a typical naphtha conversion process according to the invention shown, wherein fresh virgin feedstock 10 or hydrocracked naphtha is passed to a cracking reactor unit 20, from which the effluent 22 is distilled in separation unit 30 to provide a liquid C6+ hydrocarbon stream 32 containing unreacted naphtha, heavier olefins, etc. and a lighter cracked hydrocarbon stream 34 rich in C4 and C5 olefins, including i-butene and i-pentenes, non-etherifiable butylenes and amylenes, C1–C4 aliphatic light gas. At least the C4–C5 isoalkene-containing fraction of effluent stream 34 is reacted with methanol or other alcohols stream 38 in etherification reactor unit 40 by contacting the reactants with an acid type catalyst to produce an effluent stream 42 containing MTBE, TAME and unreacted C5-components. Conventional product recovery operations 50, such as distillation, extraction, etc. can be employed to recover the MTBE/TAME ether products as pure materials, or as a C5+ mixture 52 for fuel blending. Unreacted light C2–C4 olefinic components, methanol and any other C2–C4 alkanes or alkenes may be recovered in an olefin upgrading feedstream 54. Alternatively, LPG, ethene-rich light gas or a purge stream may be recovered as offgas stream 56, which may be further processed in a gas plant for recovery of hydrogen, methane, ethane, etc. The C2–C4 hydrocarbons and methanol are preferrably upgraded in reactor unit 60, as herein described, to provide additional high octane gasoline. A liquid hydrocarbon stream 62 is recovered from catalytic upgrading unit 60 and may be further processed by hydrogenation and blended as fuel components.

An optional hydrotreating unit may be used to convert aromatic or virgin naphtha feed 12 with hydrogen 14 in a conventional hydrocarbon saturation reactor unit 70 to decrease the aromatic content of certain fresh feedstocks or recycle streams and provide a C7+ cycloaliphatics, such as alkyl cyclohexanes, which are selectively cracked to isoalkene. A portion of unreacted paraffins or C6+ olefins/aromatics produced by cracking may be recycled from stream 32 via 32 R to units 20 and/or 70 for further processing. Similarly, such materials may be coprocessed via line 58 with feed to the olefin upgrading unit 60. In addition to oligomerization of unreacted butenes, oxygenate conversion and upgrading heavier hydrocarbons, the versatile zeolite catalysis unit 60 can convert supplemental feedstream 58 containing refinery fuel gas containing ethene, propene or other oxygenates/hydrocarbons.

Description of Zeolite Catalysts

Careful selection of catalyst components to optimize isoalkene selectivity and upgrade lower olefins is important to overall success of the integrated process. Under certain circumstances it is feasible to employ the same catalyst for naphtha cracking and olefin upgrading, although these operations may be kept separate with different catalysts being employed. The cracking catalyst may consist essentially of MCM-22 aluminosilicate zeolite, having an acid cracking activity less than 15 (standard alpha value) and moderately low constraint index (C.I.=1.5). The moderately constrained medium pore zeolite has a pore size of about 5-8A°, able to accept naphthene components found in most straight run naphtha from petroleum distillation or other alkyl cycloaliphatics.

Recent developments in zeolite technology have provided the medium pore siliceous materials having similar pore geometry. Prominent among these intermediate pore size zeolites is ZSM-5, which is usually synthesized with Bronsted acid active sites by incorporating a tetrahedrally coordinated metal, such as Al, Ga, Fe. B or mixtures thereof, within the zeolitic framework. These medium pore zeolites are favored for acid catalysis; however, the advantages of medium pore structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

Zeolite hydrocarbon upgrading catalysts preferred for use herein include the medium pore shape-selective crystalline aluminosilicate zeolites having the structure of MCM-22 and having acid cracking activity (alpha value) of about 1-15 based on active catalyst weight. While active catalyst consisting essentially of MCM-22 is preferred, it may be advantageous to employ this in combination with other catalytic materials, such as the medium pore zeolites. Representative of the ZSM-5 type medium pore shape selective zeolites are ZSM-5, ZSM-11, ZSM-12, ZSM-22, ZSM-23, ZSM-35, ZSM-48, Zeolite Beta, SSZ-25 (U.S. Pat. No. 4,954,325), PSH-3 (U.S. Pat. No. 4,439,409) and mixtures thereof with similarly structured catalytic materials. Mixtures of MCM-22 with medium (i.e., about 5-7A°) or larger pore zeolites, such as Y, mordenite, or others having a pore size greater than 7A° may be desirable. Aluminosilicate ZSM-5 is disclosed in U.S. Pat. No. 3,702,886 and U.S. Pat. No. Re. 29,948. Other suitable zeolites are disclosed in U.S. Pat. Nos. 3,709,979; 3,832,449; 4,076,979; 3,832,449; 4,076,842; 4,016,245; 4,414,423; 4,417,086; 4,517,396; 4,542,257; and 4,826,667. MCM-22 synthesis is disclosed in U.S. Pat. No. 4,954,325 (M.Rubin and P.Chu) and in U.S. Pat. No. 4,956,514 (C.T. Chu) and a heavy oil cracking process is disclosed in U.S. patent application Ser. No. 07,471,994 (Absil et al). These disclosures are incorporated herein by reference. While suitable zeolites having a coordinated metal oxide to silica molar ratio of 20:1 to 500:1 or higher may be used, it is advantageous to employ standard MCM-22, suitably modified if desired to adjust acidity. A typical zeolite catalyst component having Bronsted acid sites may consist essentially of aluminosilicate zeolite with 5 to 95 wt. % silica and/or alumina binder.

Usually the zeolite crystals have a crystal size from about 0.01 to 2 microns or more. In order to obtain the desired particle size for fluidization in the turbulent regime, the zeolite catalyst crystals are bound with a suitable inorganic oxide, such as silica, alumina, etc. to provide a zeolite concentration of about 5 to 95 wt%.

In selective cracking reactions, it is advantageous to employ a standard zeolite having a silica:alumina molar ratio of 25:1 or greater in a once-through fluidized bed unit to convert about 20 to 50 weight percent, preferably about 10-50 wt%, of the C7-C12 feedstock hydrocarbons in a single pass. Particle size distribution can be a significant factor in transport fluidization and in achieving overall homogeneity in dense bed, turbulent regime or transport fluidization. It is desired to operate the process with particles that will mix well throughout the bed. It is advantageous to employ a particle size range consisting essentially of 1 to 150 microns. Average particle size is usually about 20 to 100 microns.

In the present invention MCM-22, a new zeolite which has been found to be active for a wide variety of hydrocarbon conversions, is shown to have high activity and selectivity for the partial conversion of naphtha-range C7-C12 hydrocarbons to higher value $C_4+C5$ iso-olefins.

The synthetic porous crystalline material employed as catalyst in the selective cracking of this invention, referred to herein as "zeolite MCM-22" or simply "MCM-22", appears to be related to the composition named "PSH-3" described in U.S. Pat. No. 4,439,409. Zeolite MCM-22 does not appear to contain all the components apparently present in the PSH-3 compositions. Zeolite MCM-22 is not contaminated with other crystal structures, such as ZSM-12 or ZSM-5, and exhibits unusual sorption capacities and unique catalytic utility when compared to the PSH-3 compositions synthesized in accordance with U.S. Pat. No. 4,439,409.

Zeolite MCM-22 has a composition involving the molar relationship:

$$X_2O_3:(n)YO_2,$$

wherein X is a trivalent element, such as aluminum, boron, iron and/or gallium, preferably aluminum, Y is a tetravalent element such as silicon and/or germanium, preferably silicon, and n is at least about 10, usually from about 10 to about 150, more usually from about 10 to about 60, and even more usually from about 20 to about 40. In the as-synthesized form, zeolite MCM-22 has a formula, on an anhydrous basis and in terms of moles of oxides per n moles of $YO_2$, as follows:

$$(0.005\text{-}0.1)Na_2O:(1\text{-}4)R:X_2O_3:nYO_2;$$

wherein R is an organic component. The Na and R components are associated with the zeolite as a result of their presence during crystallization, and are easily removed by post-crystallization methods hereinafter more particularly described.

Zeolite MCM-22 is thermally stable and exhibits high surface area greater than 400 $m^2/gm$ as measured by the BET (Bruenauer, Emmet and Teller) test and unusually large sorption capacity when compared to previously described crystal structures having similar X-ray diffraction patterns. As is evident from the above formula, MCM-22 is synthesized nearly free of Na cations. It can, therefore, be used as an olefin oligomerization catalyst with acid activity without an exchange step. To the extent desired, however, the original sodium cations of the as-synthesized material can be replaced in accordance with techniques well known in the art, at least in part, by ion exchange with other cations. Preferred replacing cations include metal ions, hydrogen ions, hydrogen precursor, e.g., ammonium, ions and mixtures thereof. Particularly preferred cations are those which tailor the activity of the catalyst for olefin oligomerization. These include hydrogen, rare earth metals and metals of Groups IIA, IIIA, IVA, IB, IIB, IIIB, IVB and VIII of the Periodic Table of the Elements.

In its calcined form, zeolite MCM-22 appears to be made up of a single crystal phase with little or no detectable impurity crystal phases and has an X-ray diffraction pattern including the lines listed in Table I below:

TABLE I

| Interplanar d-Spacing (A) | Relative Intensity, I/Io × 100 |
|---|---|
| 30.0 ± 2.2 | W-M |
| 22.1 ± 1.3 | W |
| 12.36 ± 0.4 | M-VS |
| 11.03 ± 0.2 | M-S |
| 8.83 ± 0.14 | M-VS |
| 6.18 ± 0.12 | M-VS |
| 6.00 ± 0.10 | W-M |
| 4.06 ± 0.07 | W-S |
| 3.91 ± 0.07 | M-VS |
| 3.42 ± 0.06 | VS |

More specifically, the calcined form may be characterized by an X-ray diffraction pattern including the following lines:

TABLE II

| Interplanar d-Spacing (A) | Relative Intensity, I/Io × 100 |
|---|---|
| 30.0 ± 2.2 | W-M |
| 22.1 ± 1.3 | W |
| 12.36 ± 0.4 | M-VS |
| 11.03 ± 0.2 | M-S |
| 8.83 ± 0.14 | M-VS |
| 6.86 ± 0.14 | W-M |
| 6.18 ± 0.12 | M-VS |
| 6.00 ± 0.10 | W-M |
| 5.54 ± 0.10 | W-M |
| 4.92 ± 0.09 | W |
| 4.64 ± 0.08 | W |
| 4.41 ± 0.08 | W-M |
| 4.25 ± 0.08 | W |
| 4.10 ± 0.07 | W-S |
| 4.06 ± 0.07 | W-S |
| 3.91 ± 0.07 | M-VS |
| 3.75 ± 0.06 | W-M |
| 3.56 ± 0.06 | W-M |
| 3.42 ± 0.06 | VS |
| 3.30 ± 0.05 | W-M |
| 3.20 ± 0.05 | W-M |
| 3.14 ± 0.05 | W-M |
| 3.07 ± 0.05 | W |
| 2.99 ± 0.05 | W |
| 2.82 ± 0.05 | W |
| 2.78 ± 0.05 | W |
| 2.68 ± 0.05 | W |

TABLE II-continued

| Interplanar d-Spacing (A) | Relative Intensity, I/Io × 100 |
|---|---|
| 2.59 ± 0.05 | W |

These values were determined by standard techniques. The radiation was the K-alpha doublet of copper and a diffractometer equipped with a scintillation counter and an associated computer was used. The peak heights, I, and the positions as a function of 2 theta, where theta is the Bragg angle, were determined using algorithms on the computer associated with the diffractometer. From these, the relative intensities, 100 $I/I_o$, where $I_o$ is the intensity of the strongest line or peak, and d (obs.) the interplanar spacing in Angstroms Units (A), corresponding to the recorded lines, were determined. In Tables I and II, the relative intensities are given in terms of the symbols W=weak, M=medium, S=strong and VS=very strong. In terms of intensities, these may be generally designated as follows: W=0–20, M=20–40, S=40–60, VS=60–100.

It should be understood that these X-ray diffraction patterns are characteristic of all species of the present crystalline composition. The sodium form as well as other cationic forms reveal substantially the same pattern with some minor shifts in interplanar spacing and variation in relative intensity. Other minor variations can occur depending on the Y to X, e.g., silicon to aluminum, mole ratio of the particular sample, as well as its degree of thermal treatment.

Prior to its use as cracking catalyst, the MCM-22 crystals should be subjected to thermal treatment to remove part or all of any organic constituent present therein.

The zeolite MCM-22 catalyst herein should be substantially free of hydrogenating components such as tungsten, vanadium, molybdenum, rhenium, nickel, cobalt, chromium, manganese, or a noble metal such as platinum or palladium where a hydrogenation- dehydrogenation function is to be performed.

Zeolite MCM-22, especially in its metal, hydrogen and ammonium forms, can be beneficially converted to another form by thermal treatment. This thermal treatment is generally performed by heating one of these forms at a temperature of at least about 370° C. for at least 1 minute and generally not longer than 20 hours. While subatmospheric pressure can be employed for the thermal treatment, atmospheric pressure is preferred simply for reasons of convenience. The thermal treatment can be performed at a temperature of up to about 925° C.

Prior to its use in the process of this invention, the zeolite MCM-22 crystals should be dehydrated, at least partially. This can be done by heating the crystals to a temperature in the range of from about 200° C. to about 595° C. in an inert atmosphere, such as air, nitrogen, etc. and at atmospheric, subatmospheric or superatmospheric pressures for between about 30 minutes to about 48 hours. Dehydration can also be performed at room temperature merely by placing the crystalline material in a vacuum, but a longer time is required to obtain a sufficient amount of dehydration.

Zeolite MCM-22 can be prepared from a reaction mixture containing sources of alkali or alkaline earth metal (M), e.g., sodium or potassium, cation, an oxide of trivalent element X, e.g, aluminum, an oxide of tetravalent element Y, e.g., silicon, an organic (R) directing agent, hereinafter more particularly described, and water, said reaction mixture having a composition, in terms of mole ratios of oxides, within the following ranges:

| Reactants | Useful | Preferred |
|---|---|---|
| $YO_2/X_2O_3$ | 10-60 | 10-40 |
| $H_2O/YO_2$ | 5-100 | 10-50 |
| $OH^-/YO_2$ | 0.01-1.0 | 0.1-0.5 |
| $M/YO_2$ | 0.01-2.0 | 0.1-1.0 |
| $R/YO_2$ | 0.05-1.0 | 0.1-0.5 |

In a preferred method of synthesizing zeolite MCM-22, the $YO_2$ reactant contains a substantial amount of solid $YO_2$, e.g., at least about 30 wt.% solid $YO_2$. Where $YO_2$ is silica, the use of a silica source containing at least about 30 wt.% solid silica, e.g., Ultrasil (a precipitated, spray dried silica containing about 90 wt.% silica) or HiSil (a precipitated hydrated $SiO_2$ containing about 87 wt.% silica, about 6 wt.% free $H_2O$ and about 4.5 wt.% bound $H_2O$ of hydration and having a particle size of about 0.02 micron) favors crystal formation from the above mixture and is a distinct improvement over the synthesis method disclosed in U.S. Pat. No. 4,439,409. If another source of oxide of silicon, e.g., Q-Brand (a sodium silicate comprised of about 28.8 wt.% of $SiO_2$, 8.9 wt.% $Na_2O$ and 62.3 wt.% $H_2O$) is used, crystallization may yield little if any MCM-22 crystalline material and impurity phases of other crystal structures, e.g., ZSM-12, may be produced. Preferably, therefore, the $YO_2$, e.g., silica, source contains at least about 30 wt.% solid $YO_2$, e.g., silica, and more preferably at least about 40 wt.% solid $YO_2$, e.g., silica.

Crystallization of the MCM-22 crystalline material can be carried out at either static or stirred conditions in a suitable reactor vessel such as, e.g., polypropylene jars or teflon-lined or stainless steel autoclaves. The total useful range of temperatures for crystallization is from about 80° C. to about 225° C. for a time sufficient for crystallization to occur at the temperature used, e.g., from about 25 hours to about 60 days. Thereafter, the crystals are separated from the liquid and recovered.

The organic directing agent for use in synthesizing zeolite MCM-22 from the above reaction mixture is hexamethyleneimine.

It should be realized that the reaction mixture components can be supplied by more than one source. The reaction mixture can be prepared either batchwise or continuously. Crystal size and crystallization time of the MCM-22 crystalline material will vary with the nature of the reaction mixture employed and the crystallization conditions.

In all cases, synthesis of the MCM-22 crystals is facilitated by the presence of at least about 0.01 percent, preferably about 0.10 percent and still more preferably about 1 percent, seed crystals (based on total weight) of the crystalline product.

The MCM-22 crystals can be shaped into a wide variety of particle sizes. Generally speaking, the particles can be in the form of a powder, a granule, or a molded product such as an extrudate having a particle size sufficient to pass through a 2 mesh (Tyler) screen and be retained on a 400 mesh (Tyler) screen. In cases where the catalyst is molded, such as by extrusion, the crystals an be extruded before drying or partially dried and then extruded.

It may be desired to incorporate the MCM-22 crystalline material with another material which is resistant to the temperatures and other conditions employed in the olefin oligomerization process of this invention. Such materials include active and inactive materials and synthetic or naturally occurring zeolites as well as inorganic materials such as clays, silica and/or metal oxides such as alumina. The latter may be either naturally occurring or in the form of gelatinous precipitates or gels including mixtures of silica and metal oxides. Use of a material in conjunction with zeolite MCM-22, i.e., combined therewith or present during its synthesis, which itself is catalytically active may change the conversion and/or selectivity of the catalyst. Inactive materials suitably serve as diluents to control the amount of conversion so that oligomerized olefin products can be obtained economically and orderly without employing other means for controlling the rate of reaction. These materials may be incorporated into naturally occurring clays, e.g., bentonite and kaolin, to improve the crush strength of the catalyst under commercial operating conditions. Said materials, i.e., clays, oxides, etc., function as binders for the catalyst. It is desirable to provide a catalyst having good crush strength because in commercial use, it is desirable to prevent the catalyst from breaking down into powder-like materials. These clay binders have been employed normally only for the purpose of improving the crush strength of the catalyst.

Naturally occurring clays which can be composited with MCM-22 crystals include the montmorillonite and kaolin family, which families include the subbentonites, and the kaolins commonly known as Dixie, McNamee, Georgia and Florida clays or others in which the main mineral constituent is halloysite, kaolinite, dickite, nacrite, or anauxite. Such clays can be used in the raw state as originally mined or initially subjected to calcination, acid treatment or chemical modification. Binders useful for compositing with zeolite MCM-22 also include inorganic oxides, notably alumina.

In addition to the foregoing materials, the MCM-22 crystals can be composited with a porous matrix material such as silica-alumina, silica-magnesia, silica-zirconia, silica-thoria, silica-beryllia, silica-titania as well as ternary compositions such as silica-alumina-thoria, silica-alumina-zirconia silica-alumina-magnesia and silica-magnesia-zirconia. It may also be advantageous to provide at least a part of the foregoing matrix materials in colloidal form so as to facilitate extrusion of the bound catalyst component(s).

The relative proportions of finely divided crystalline material and inorganic oxide matrix vary widely, with the crystal content ranging from about 1 to about 90 percent by weight and more usually, particularly when the composite is prepared in the form of beads, in the range of about 2 to about 80 weight percent of the composite.

The stability of the catalyst of the invention may be increased by steaming. U.S. Pat. Nos. 4,663,492; 4,594,146; 4,522,929; and 4,429,176, the entire disclosures of which are incorporated herein by reference, describe conditions for the steam stabilization of zeolite catalysts which can be utilized to steam-stabilize the catalyst for use herein. The steam stabilization conditions include contacting the catalyst with, e.g., 5-100% steam at a temperature of at least about 300° C. (e.g., 300°-650° C.) for at least one hour (e.g., 1-200 hours) at a pressure of 101-2,500 kPa. In a more particular embodiment, the catalyst can be made to undergo steaming with 75-100% steam at 315°-500° C. and atmospheric pressure for 2-25 hours. In accordance with the steam stabilization treatment described in the above-mentioned patents, the steaming of the catalyst can take place under conditions sufficient to initially increase the Alpha Value of the catalyst, the significance of which is discussed infra. and produce a steamed catalyst having a peak Alpha Value. If desired, steaming can be continued to subsequently reduce the Alpha Value from the peak Alpha Value to an Alpha Value which is substantially the same as the Alpha Value of the unsteamed catalyst.

In order to more fully illustrate the process of this invention and the manner of practicing same, the following examples are presented. In examples illustrative of the synthesis of zeolite MCM-22, whenever sorption data are set forth for comparison of sorptive capacities for water, cyclohexane and/or n-hexane, they were Equilibrium Adsorption values determined as follows:

A weighed sample of the calcined absorbent was contacted with the desired pure absorbate vapor in an adsorption chamber, evacuated to less than 1 mm Hg and contacted with 12 Torr of water vapor or 40 Torr of n-hexane or 40 Torr of cyclohexane vapor, pressures less than the vapor-liquid equilibrium pressure of the respective adsorbate at 90° C. The pressure was kept constant (within about ±0.5 mm Hg) by addition of adsorbate vapor controlled by a manostat during the adsorption period, which did not exceed about 8 hours. As adsorbate was adsorbed by the MCM-22 crystalline material, the decrease in pressure caused the manostat to open a valve which admitted more adsorbate vapor to the chamber to restore the above control pressures. Sorption was complete when the pressure change was not sufficient to activate the manostat. The increase in weight was calculated as the adsorption capacity of the sample in g/100 g of calcined adsorbant. Zeolite MCM-22 always exhibits Equilibrium Adsorption values of greater than about 10 wt.% for water vapor, greater than about 4.5 wt.%, usually greater than about 7 wt.% for cyclohexane vapor and greater than about 10 wt.% for n-hexane vapor. These vapor sorption capacities are a notable distinguishing feature of zeolite MCM-22 and are preferred for the zeolite component of catalyst for use herein.

When Alpha Value is examined, it is noted that the Alpha Value is an approximate indication of the catalytic cracking activity of the catalyst compared to a standard catalyst and it gives the relative rate constant (rate of normal hexane conversion per volume of catalyst per unit time). It is based on the activity of the highly active silica-alumina cracking catalyst taken as an Alpha of 1 (Rate Constant $=0.016$ sec $^{-1}$). The Alpha Test is described in U.S. Pat. No. 3,354,078, in the *Journal of Catalysis*, Vol. 4, p. 527 (1965); Vol. 6, p. 278 (1966); and Vol. 61, p. 395 (1980), each incorporated herein by reference as to that description. The experimental conditions of the test used herein include a constant temperature of 538° C. and a variable flow rate as described in detail in the *Journal of Catalysis*, Vol. 61, p. 395.

EXAMPLE 1

One part of sodium aluminate (43.5% $Al_2O_3$, 32.2% $Na_2O$, 25.6% $H_2O$) was dissolved in a solution containing 1 part of 50% NaOH solution and 103.13 parts $H_2O$. To this was added 4.50 parts hexamethyleneimine. The resulting solution was added to 8.55 parts of Ultrasil, a precipitated, spray-dried silica (about 90% $SiO_2$).

The reaction mixture had the following composition, in mole ratios:

$SiO_2/Al_2O_3=30.0$
$OH^-/SiO_2=0.18$
$H_2O/SiO_2=44.9$
$Na/SiO_2=0.18$
$R/SiO_2=0.35$ where R is hexamethyleneimine.

The mixture was crystallized in a stainless steel reactor, with stirring, at 150° C. for 7 days. The crystalline product was filtered, washed with water and dried at 120° C. After a 20 hour calcination at 538° C., the X-ray diffraction pattern contained the major lines listed in Table III. The sorption capacities of the calcined material were measured to be:

$H_2O$ 15.2 wt.%
Cyclohexane 14.6 wt.%
n-Hexane 16.7 wt.%

The surface area of the calcined crystalline material was measured to be 494 $m^2/g$.

The chemical composition of the uncalcined material was determined to be as follows:

| Component | wt. % |
|---|---|
| $SiO_2$ | 66.9 |
| $Al_2O_3$ | 5.40 |
| Na | 0.03 |
| N | 2.27 |
| Ash | 76.3 |
| $SiO_2/Al_2O_3$, mole ratio = | 21.1 |

TABLE III

| Degrees 2-Theta | Interplanar d-Spacing (A) | $I/I_o$ |
|---|---|---|
| 2.80 | 31.55 | 25 |
| 4.02 | 21.98 | 10 |
| 7.10 | 12.45 | 96 |
| 7.95 | 11.12 | 47 |
| 10.00 | 8.85 | 51 |
| 12.90 | 6.86 | 11 |
| 14.34 | 6.18 | 42 |
| 14.72 | 6.02 | 15 |
| 15.90 | 5.57 | 20 |
| 17.81 | 4.98 | 5 |
| 20.20 | 4.40 | 20 |
| 20.91 | 4.25 | 5 |
| 21.59 | 4.12 | 20 |
| 21.92 | 4.06 | 13 |
| 22.67 | 3.92 | 30 |
| 23.70 | 3.75 | 13 |
| 24.97 | 3.57 | 15 |
| 25.01 | 3.56 | 20 |
| 26.00 | 3.43 | 100 |
| 26.69 | 3.31 | 14 |
| 27.75 | 3.21 | 15 |
| 28.52 | 3.13 | 10 |
| 29.01 | 3.08 | 5 |
| 29.71 | 3.01 | 5 |
| 31.61 | 2.830 | 5 |
| 32.21 | 2.779 | 5 |
| 33.35 | 2.687 | 5 |
| 34.61 | 2.592 | 5 |

EXAMPLE 2

A portion of the calcined crystalline product of Example 1 was tested in the Alpha Test and was found to have an Alpha Value of 224.

EXAMPLES 3-5

Three separate synthesis reaction mixtures were prepared with compositions indicated in Table IV. The mixtures were prepared with sodium aluminate, sodium hydroxide, Ultrasil, hexamethyleneimine (R) and water. The mixtures Were maintained at 150° C., 143° C. and 150° C., respectively, for 7, 8 and 6 days respectively in stainless steel autoclaves at autogenous pressure. Solids were separated from any unreacted components by filtration and then water washed, followed by drying at 120° C. The product crystals were subjected to X-ray diffraction, sorption, surface area and chemical analyses. The results of the sorption, surface area and chemical analyses are presented in Table IV. The sorption and surface area measurements were of the calcined product.

TABLE IV

| Example | 3 | 4 | 5 |
|---|---|---|---|
| Synthesis Mixture, mole ratios | | | |
| $SiO_2/Al_2O_3$ | 30.0 | 30.0 | 30.0 |
| $OH^-/SiO_2$ | 0.18 | 0.18 | 0.18 |
| $H_2O/SiO_2$ | 19.4 | 19.4 | 44.9 |
| $Na/SiO_2$ | 0.18 | 0.18 | 0.18 |
| $R/SiO_2$ | 0.35 | 0.35 | 0.35 |
| Product Composition, Wt. % | | | |
| $SiO_2$ | 64.3 | 68.5 | 74.5 |
| $Al_2O_3$ | 4.85 | 5.58 | 4.87 |
| Na | 0.08 | 0.05 | 0.01 |
| N | 2.40 | 2.33 | 2.12 |
| Ash | 77.1 | 77.3 | 78.2 |
| $SiO_2/Al_2O_3$, mole ratio | 22.5 | 20.9 | 26.0 |
| Adsorption Wt. % | | | |
| $H_2O$ | 14.9 | 13.6 | 14.6 |
| Cyclohexane | 12.5 | 12.2 | 13.6 |
| n-Hexane | 14.6 | 16.2 | 19.0 |
| Surface Area, $m^2/g$ | 481 | 492 | 487 |

EXAMPLE 6

Quantities of the calcined (538° C. for 3 hours) crystalline silicate products of Examples 3, 4 and 5 were tested in the Alpha Test and found to have Alpha Values of 227, 180 and 187, respectively.

EXAMPLE 7

To demonstrate a further preparation of the present zeolite, 4.49 parts of hexamethyleneimine was added to a solution containing 1 part of sodium aluminate, 1 part of 50% NaOH solution and 44.19 parts of $H_2O$. To the combined solution were added 8.54 parts of Ultrasil silica. The mixture was crystallized with agitation at 145° C. for 59 hours and the resultant product was water washed and dried at 120° C.

Product chemical composition, surface area and adsorption analyses results were as set forth in Table V:

TABLE V

| | |
|---|---|
| Product Composition (uncalcined) | |
| C | 12.1 wt. % |
| N | 1.98 wt. % |
| Na | 640 ppm |
| $Al_2O_3$ | 5.0 wt. % |
| $SiO_2$ | 74.9 wt. % |
| $SiO_2/Al_2O_3$, mole ratio | 25.4 |
| Adsorption, wt. % | |
| Cyclohexane | 9.1 |
| N-Hexane | 14.9 |
| $H_2O$ | 16.8 |
| Surface Area, $m^2/g$ | 479 |

EXAMPLE 8

Twenty-five grams of solid crystal product from Example 7 were calcined in a flowing nitrogen atmospheres at 538° C. for 5 hours, followed by purging with 5% oxygen gas (balance $N_2$) for another 16 hours at 538° C.

Individual 3g samples of the calcined material were ion-exchanged with 100 ml of 0.1N TEABr, TPABr and $LaCl_3$ solution separately. Each exchange was carried out at ambient temperature for 24 hours and repeated three times. The exchanged samples were collected by filtration, water-washed to be halide-free and dried. The compositions of the exchanged samples are tabulated below demonstrating the exchange capacity of the present crystalline silicate for different ions.

| Exchange Ions<br>Ionic Composition, wt. % | TEA | TPA | La |
|---|---|---|---|
| Na | 0.095 | 0.089 | 0.063 |
| N | 0.30 | 0.38 | 0.03 |
| C | 2.89 | 3.63 | — |
| La | — | — | 1.04 |

EXAMPLE 9

The La-exchanged sample from Example 8 was sized to 14 to 25 mesh and then calcined in air at 538° C. for 3 hours. The calcined material had an Alpha Value of 173.

EXAMPLE 10

The calcined sample La-exchanged material from Example 9 was severely steamed at 649° C. in 100% steam for 2 hours. The steamed sample had an Alpha Value of 22, demonstrating that the zeolite has very good stability under severe hydrothermal treatment.

EXAMPLE 11

This example illustrates the preparation of the present zeolite where X in the general formula, supra, is boron. Boric acid, 2.59 parts, was added to a solution containing 1 part of 45% KOH solution and 42.96 parts $H_2O$. To this was added 8.56 parts of Ultrasil silica, and the mixture was thoroughly homogenized. A 3.88 parts quantity of hexamethyleneimine was added to the mixture.

The reaction mixture had the following composition in mole ratios:

$SiO_2/B_2O_3=6.1$
$OH^-/SiO_2=0.06$
$H_2O/SiO_2=19.0$
$K/SiO_2=0.06$
$R/SiO_2=0.30$ where R is hexamethyleneimine.

The mixture was crystallized in a stainless steel reactor, with agitation, at 150° C. for 8 days. The crystalline product was filtered, washed with water and dried at 120° C. A portion of the product was calcined for 6 hours at 540° C. and found to have the following sorption capacities:

$H_2O$ (12 Torr): 11.7 wt.%
Cyclohexane (40 Torr): 7.5 wt.%
n-Hexane (40 Torr): 11.4 wt.%

The surface area of the calcined crystalline material was measured (BET) to be $405m^2/g$.

The chemical composition of the uncalcined material was determined to be as follows:
N: 1.94 wt.%
Na: 175 ppm
K: 0.60 wt.%
Boron: 1.04 wt.%
$Al_2O_3$: 920 ppm
$SiO_2$: 75.9 wt.%
Ash: 74.11 wt.%
$SiO_2Al_2O_3$, molar ratio=1406
$SiO_2/(Al+B)_2O_3$, molar ratio=25.8

EXAMPLE 12

A portion of the calcined crystalline product of Example 11 was treated with $NH_4Cl$ and again calcined. The final crystalline product was tested in the Alpha Test and found to have an Alpha Value of 1.

EXAMPLE 13

This example illustrates another preparation of the zeolite in which X of the general formula, supra, is boron. Boric acid, 2.23 parts, was added to a solution of 1 part of 50% NaOH solution and 73.89 parts $H_2O$. To this solution was added 15.29 parts of HiSil silica followed by 6.69 parts of hexamethyleneimine. The reaction mixture had the following composition in mole ratios:
$SiO_2/B_2O_3=12.3$
$OH^-/SiO_2=0.056$
$H_2O/SiO_2=18.6$
$K/SiO_2=0.056$
$R/SiO_2=0.30$
where R is hexamethyleneimine.

The mixture was crystallized in a stainless steel reactor, with agitation, at 300° C. for 9 days. The crystalline product was filtered, washed with water and dried at 120° C. The sorption capacities of the calcined material (6 hours at 540° C.) were measured:
$H_2O$ (12 Torr): 14.4 wt.%
Cyclohexane (40 Torr): 4.6 wt.%
n-Hexane (40 Torr): 14.0 wt.%

The surface area of the calcined crystalline material was measured to be 438m$^2$/g.

The chemical composition of the uncalcined material was determined to be as follows:

| Component | Wt. % |
|---|---|
| N | 2.48 |
| Na | 0.06 |
| Boron | 0.83 |
| $Al_2O_3$ | 0.50 |
| $SiO_2$ | 73.4 |
| $SiO_2/Al_2O_3$, molar ratio = | 249 |
| $SiO_2/(Al + B)_2O_3$, molar ratio = | 28.2 |

EXAMPLE 14

A portion of the calcined crystalline product of Example 13 was tested in the Alpha Test and found to have an Alpha Value of 5.

EXAMPLE 15

Another zeolite MCM-22 sample was prepared by adding 4.49 parts quantity of hexamethyleneimine to a mixture containing 1.00 part sodium aluminate, 1.00 part 50% NaOH, 8.54 parts Ultrasil VN3 and 44.19 parts deionized $H_2O$. The reaction mixture was heated to 143° C. (290° F.) and stirred in an autoclave at that temperature for crystallization. After full crystallinity was achieved, the majority of the hexamethyleneimine was removed from the autoclave by controlled distillation and the zeolite crystals separated from the remaining liquid by filtration, washed with deionized $H_2O$ and dried. The zeolite was then calcined in nitrogen at 540° C., exchanged with an aqueous solution of ammonium nitrate and calcined in air at 540° C. The zeolite was tabletted, crushed and sized to 30/40 mesh.

| | |
|---|---|
| Surface Area (BET), m$^2$/g | 503 |
| $SiO_2/Al_2O_3$ (molar) | 27 |
| Na, ppm | 495 |
| Alpha | 693 |
| Sorption Properties, wt. % | |
| $H_2O$ | 15.0 |
| $CyC_6$ | 12.5 |
| n-$C_6$ | 16.0 |
| Ash at 1000° C., wt. % | 99.05 |

The MCM-22 catalyst had the following properties:

General Cracking Process Conditions

The selective cracking conditions include total pressure up to about 500 kPa and reaction temperature of about 425° to 650° C., preferrably at pressure less than 175 kPa and temperature in the range of about 450° to 540° C., wherein the cracking reaction produces less than 5% C2-light paraffin gas, based on fresh naphtha feedstock.

The cracking reaction severity is maintained by employing a weight hourly space velocity of about 1 to 50 (preferably about 1-10 WHSV based on active catalyst solids) and contact time less than 10 seconds, usually about 1-2 sec. While fixed bed, moving bed or dense fluidized bed catalyst reactor systems may be adapted for the cracking step, it is preferred to use a vertical riser reactor with fine catalyst particles being circulated in a fast fluidized bed.

Etherificaton Operation

The reaction of methanol with isobutylene and isoamylenes at moderate conditions with a resin catalyst is known technology, as provided by R. W. Reynolds, et al., *The Oil and Gas Journal*, June 16, 1975, and S. Pecci and T. Floris, *Hydrocarbon Processing*, December 1977. An article entitled "MTBE and TAME—A Good Octane Boosting Combo", by J. D. Chase, et al., *The Oil and Gas Journal*, Apr. 9, 1979, pages 149-152, discusses the technology. A preferred catalyst is a sulfonic acid ion exchange resin which etherifies and isomerizes the reactants. A typical acid catalyst is Amberlyst 15 sulfonic acid resin.

Processes for producing and recovering MTBE and other methyl tert-alkyl ethers for $C_4$-$C_7$ iso-olefins are known to those skilled in the art, such as disclosed in U.S. Pat. No. 4,788,365 (Owen et al), incorporated by reference. Various suitable extraction and distillation techniques are known for recovering ether and hydrocarbon streams from etherification effluent; however, it is advantageous to convert unreacted methanol and other volatile components of etherificaton effluent by zeolite catalysis.

Residual Olefin Uooradino Reactor Operation

Zeolite catalysis technology for upgrading lower aliphatic hydrocarbons and oxygenates to liquid hydrocarbon products are well known. Commercial aromatization (M2-Forming) and Mobil Olefin to Gasoline/-Distillate (MOG/D) processes employ shape selective medium pore zeolite catalysts for these processes. It is understood that the present zeolite conversion unit operation can have the characteristics of these catalysts and processes to produce a variety of hydrocarbon products, especially liquid aliphatic and aromatics in the $C_5$–$C_9$ gasoline range.

In addition to the methanol and olefinic components of the reactor feed, suitable olefinic supplemental feedstreams may be added to the preferred olefin upgrading reactor unit. Non-deleterious components, such as lower paraffins and inert gases, may be present. The reaction severity conditions can be controlled to optimize yield of $C_3$–$C_5$ paraffins, olefinic gasoline or $C_6$–$C_8$ BTX hydrocarbons, according to product demand. Reaction temperatures and contact time are significant factors in the reaction severity, and the process parameters are followed to give a substantially steady state condition wherein the reaction severity is maintained within the limits which yield a desired weight ratio of propane to propene in the reaction effluent.

In a dense bed or turbulent fluidized catalyst bed the conversion reactions are conducted in a vertical reactor column by passing hot reactant vapor or lift gas upwardly through the reaction zone at a velocity greater than dense bed transition velocity and less than transport velocity for the average catalyst particle. A continuous process is operated by withdrawing a portion of coked catalyst from the reaction zone, oxidatively regenerating the withdrawn catalyst and returning regenerated catalyst to the reaction zone at a rate to control catalyst activity and reaction severity to effect feedstock conversion.

Upgrading of olefins is taught by Owen et al in U.S. Pat. Nos. 4,788,365 and 4,090,949, incorporated herein by reference. In a typical process, the methanol and olefinic feedstreams are converted in a catalytic reactor under elevated temperature conditions and suitable process pressure to produce a predominantly liquid product consisting essentially of $C_6$+hydrocarbons rich in gasoline-range paraffins and aromatics. The reaction temperature for olefin upgrading can be carefully controlled in the operating range of about 250° C. to 650° C., preferably at average reactor temperature of 350° C. to 500° C.

Examples of naphtha cracking reactions are demonstrated to show selectivity in producing isoalkens. Unless otherwise indicated, the example employ standard H-ZSM-12 zeolite catalyst (C.I.=2), steamed to reduce the acid cracking activity (alpha value) to about 11. The test catalyst is 65% zeolite, bound with alumina, and extruded. The feedstocks employed are virgin light naphtha fractions (150°-350° F./65°-165° C.) consisting essentially of C7-C12 hydrocarbons, as set forth in Table F.

TABLE F

| Feedstock (Straight Run Naphtha) | Arab Light Paraffinic Naph |
|---|---|
| Boiling Point, °F. | C7-350 |
| API Gravity | 58.6 |
| H, wt % | 14.52 |

TABLE F-continued

| Feedstock (Straight Run Naphtha) | Arab Light Paraffinic Naph |
|---|---|
| S, wt % | 0.046 |
| N, ppm | 0.3 |
| Composition, wt % | |
| Parraffins | 65 |
| Naphthenes | 21 |
| Aromatics | 14 |

Several runs are made at about 500°-540° C. (960°-1000° F.), averaging 1-2 seconds contact time at WHSV 1-4, based on total catalyst solids in a fixed bed reactor unit at conversion rates from about 20-45%. Results are given in Table X, which shows the detailed product distribution obtained from cracking these raw naphtha (straight run Arab light) over ZSM-12 and MCM-22 catalyst (65% zeolite, 35% alumina binder, 10-15 alpha) in a fixed-bed catalytic reactor at 35 psig N2 atmosphere.

TABLE X

| Selective Naphtha Cracking Over Zeolite | | |
|---|---|---|
| Run# | 1 | 2 |
| Avg Rx T, °C. | 540 | 540° C. |
| Contact Time | 1 Second | 1 Second |
| Time on stream | 30 min. | 30 min. |
| C5− Conv, wt % | 26.2 | 26.1 |
| Product Selectivity, % | | |
| C1-C2 alkane | 3.0 | 3.4 |
| nC3-nC5 alkane | 19.0 | 12.9 |
| nC5− alkane | 22.0 | 16.3 total |
| C2= | 4.8 | 6.0 |
| C3= | 29.9 | 32.8 |
| C4= | 26.6 | 24.0 total |
| iC4= | 11.0 | 10.1 |
| C5= | 8.9 | 8.0 total |
| iC5= | 6.1 | 5.4 |
| C5− alkenes | 70.2 | 70.8 total |
| C4-C5 branched aliphatics | 26.3 | 28.2 total |

These data show that significant conversion of the paraffins and naphthene at these conditions do occur to produce iso-alkenes in good yield, with improved yield of isobutane and isopentanes and increased yield of total C4-C5 branched aliphatics. The other products include straight chain n-C4-C5 olefins, C2-C3 olefins and C1-C3aliphatics. Yield of total C5- olefin is increased slightly. The reaction rate is stable over a long stream time under continuous process conditions.

The olefinic C5- product of Example X is etherified by reaction with methanol over acid catalyst to product MTBE and TAME octane improvers. Isobutane and isopentanes from cracking effluent may be recovered from the primary stage effluent or passed through the etherification unit operation unreacted. These C4-C5 isoalkanes can be upgraded to high octane fuel components by conventional HF alkylation with propene or butene. Alternatively, the isoalkanes can be dehydrogenated to the corresponding isoalkenes and etherified with primary isoalkene products to make tertiary alkyl ethers.

Fluidized bed configuration is preferred, particularly at high temperature (800°-1200° F.) and short-contact time (<10 sec) conditions. Moving-bed and fixed-bed reactors are also viable for high activity and stable catalysts which might not require frequent regeneration. Preferred process conditions for fixed and moving -bed configuration would be in low reactor temperature (500°-800° F.), space velocities (1-10 WHSV) and in the substantial absense of added hydrogen.

Another process variation contemplates optimizing zeolite isomerization of C4- ether reaction effluent components to produce additional isobutene and isoamylenes for recycle and/or lighter olefins for further upgrading by zeolite catalysis.

Various modifications can be made to the system, especially in the choice of equipment and non-critical processing steps. While the invention has been described by specific examples, there is no intent to limit the inventive concept as set forth in the following claims.

We claim:

1. A process for upgrading paraffinic naphtha to high octane fuel comprising:

contacting a fresh naphtha feedstock stream containing a major amount of C7+ alkanes and naphthenes with medium pore acid cracking catalyst having the structure of MCM-22 under low pressure selective cracking conditions effective to produce at least 10 wt% total C4-C5 isoalkene and at least 10 wt% total C4-C5 isoalkane, said cracking catalyst being substantially free of hydrogenation-dehydrogenation metal components and having an acid cracking activity less than 15;

separating cracking effluent to obtain a light olefinic fraction rich in C4-C5 isoalkene and a C6+ liquid fraction of enhanced octane value; and etherifying the C4-C5 isoalkene fraction by catalytic reaction with lower alkanol to produce tertiary-alkyl ether product.

2. A process for upgrading paraffinic naphtha to high octane fuel according to claim 1 wherein the fresh feedstock contains about 15 to 50 wt% C7-C12 alkanes, about 15 to 50 wt% C7+ cycloaliphatic hydrocarbons, and less than 40% aromatics; the cracking conditions include total pressure up to about 500 kPa, space velocity greater than 1/hr WHSV, and reaction temperature of about 425° to 650° C.; the cracking catalyst comprises metallosilicate zeolite having a constraint index of about 1.5; and wherein the cracking reaction produces less than 5% C2- light paraffin gas based on fresh naphtha feedstock.

3. A process for upgrading naphtha comprising predominantly alkanes and/or naphthenes according to claim 2 wherein the cracking catalyst consists essentially of aluminosilicate MCM-22; the cracking reaction is maintained at about 450° to 540° C. and weight hourly space velocity of about 1 to 100/hr; and wherein the fresh feedstock consists essentially of C7+ paraffinic virgin petroleum naphtha boiling in the range of about 65° to 175° C.

4. A process for upgrading paraffinic naphtha to high octane fuel according to claim 1 wherein at least a portion of the C6+ fraction from cracking effluent is recycled with fresh feedstock for further conversion under cracking conditions; and wherein isobutene and isoamylene recovered from naphtha cracking are etherified with methanol to produce methyl t-butyl ether and methyl t-amyl ether.

5. A process for upgrading paraffinic naphtha to high octane fuel by contacting a fresh virgin naphtha feedstock stream containing C7-C12 alkanes and naphthenes with a fluidized bed of medium pore acid zeolite cracking catalyst containing MCM-22 under low pressure selective cracking conditions effective to produce at least 10 wt% C4-C5 isoalkene and increased isoparaffin, said cracking catalyst being substantially free of hydrogenation-dehydrogenation metal components; and separating cracking effluent to obtain a light olefinic fraction rich in C4-C5 isoalkene and a C6+ liquid fraction of enhanced octane value containing less than 20 wt% aromatic hydrocarbons.

6. A process for upgrading paraffinic naphtha to high octane fuel according to claim 5 wherein the fresh feedstock contains at least 15 wt% C7+ cycloaliphatic hydrocarbons and less than 20% aromatics; the cracking conditions include total pressure up to about 500 kPa and reaction temperature of about 425° to 650° C.; the cracking catalyst comprises aluminosilicate zeolite MCM-22 having an acid cracking activity less than 15.

7. A process for upgrading paraffinic naphtha to high octane fuel according to claim 5 wherein petroleum naphtha containing aromatic hydrocarbon is hydrotreated to convert aromatic components to cycloaliphatic hydrocarbons to provide fresh feedstock containing less than 10 wt% aromatics.

8. The process of claim 5 wherein the fluidized bed catalyst is contacted with the feedstock in a vertical riser reactor during a short contact period in a transport regime and separated for catalyst recycle.

9. The process of claim 8 wherein the contact period is less than 10 seconds, and the space velocity is about 1-10, based on active zeolite catalyst solids.

10. A process for upgrading paraffinic naphtha to high octane fuel comprising:

contacting a fresh paraffinic petroleum naphtha feedstock stream having a normal boiling range of about 65° to 175° C. for about 0.5 to 10 seconds with a first fluidized bed of medium pore acid cracking catalyst comprising MCM-22 zeolite under low pressure selective cracking conditions effective to produce at least 28 wt% total C4-C5 branched aliphatic hydrocarbons containing isobutene, isoamylenes, isobutane and isopentanes;

separating cracking effluent to obtain a light olefinic fraction rich in C4-C5 tertiary alkenes; and etherifying the C4-C5 isoalkene fraction by catalytic reaction with lower alkanol to produce tertiary-alkyl ether product; and recovering isobutane and isopentanes from cracking effluent and further converting said isobutane and isopentane to high octane fuel components.

11. A process for upgrading paraffinic naphtha to high octane fuel according to claim 10 wherein the fresh feedstock contains about C7-C10 alkanes cycloaliphatic hydrocarbons, and is substantially free of aromatics; the cracking conditions include total pressure up to about 500 kPa and reaction temperature of about 425° to 650° C.; the cracking catalyst comprises aluminosilicate zeolite having a constraint index of about 1.5; and wherein the cracking reaction produces less than 5% C2- light paraffin gas based on fresh naphtha feedstock.

12. A process for upgrading paraffinic naphtha to high octane fuel according to claim 11 wherein the cracking catalyst consists essentially of MCM-22, said cracking catalyst being substantially free of hydrogenation-dehydrogenation metal components and having an acid cracking activity less than 15; and wherein the cracking reaction is maintained at about 450° to 540° C. and weight hourly space velocity of about 1 to 50.

13. A process for upgrading paraffinic naphtha to high octane fuel according to claim 10 wherein at least a portion of the C6+ fraction from cracking effluent is recycled with fresh feedstock for further conversion under cracking conditions; and wherein isobutene and isoamylene recovered from naphtha cracking are etherified with methanol to produce methyl t-butyl ether and methyl t-amyl ether.

14. A process for upgrading paraffinic naphtha to high octane fuel comprising:

contacting a fresh naphtha feedstock stream containing a major amount of C7+ alkanes and naphthenes with medium pore acid MCM-22 cracking catalyst under low pressure selective cracking conditions effective to produce at least 20 wt% selectivity to isomeric C4–C5 aliphatics containing C4–C5 isoalkene and at least 10 wt% C4–C5 isoalkane, said cracking catalyst being substantially free of hydrogenation-dehydrogenation metal components and having an acid cracking activity less than 15;

separating cracking effluent to obtain an olefinic fraction rich in C4–C5 isoalkene and a C6+ fraction;

etherifying the olefinic C4–C5 fraction by catalytic reaction with lower alkanol to produce tertiary-alkyl ether product; and converting residual C4–C5 isoalkane to provide high octane fuel components.

15. A process for upgrading paraffinic naphtha to high octane fuel according to claim 14 wherein the fresh feedstock contains at least 20 wt% C7–C12 alkanes, at least 15 wt% C7+ cycloaliphatic hydrocarbons, and less than 40% aromatics; the cracking conditions include total pressure up to about 500 kPa, space velocity greater than 1/hr WHSV, and reaction temperature of about 425° to 650° C.; and wherein the cracking reaction produces less than 5% C2- light gas based on fresh naphtha feedstock.

16. A process for upgrading naphtha comprising predominantly alkanes and/or naphthenes according to claim 14 wherein the cracking catalyst consists essentially of aluminosilicate MCM-22 zeolite; the cracking reaction is maintained at about 450° to 540° C. and weight hourly space velocity of about 0.5 to 100/hr; and wherein the fresh feedstock consists essentially of C7+ paraffinic virgin petroleum naphtha boiling in the range of about 65° to 175° C.

17. A process for upgrading paraffinic naphtha to high octane fuel by contacting a fresh virgin naphtha feedstock stream containing predominantly C7–C12 alkanes and naphthenes with acid MCM-22 zeolite cracking catalyst under low pressure selective cracking conditions effective to produce at least 10 wt% C4–C5 isoalkene and increased yield of isobutane and isopentanes.

18. A process for upgrading paraffinic naphtha to high octane fuel according to claim 17 wherein the fresh feedstock contains at least 15 wt% C7+ cycloaliphatic hydrocarbons and less than 20% aromatics; the cracking conditions include total pressure up to about 500 kPa and reaction temperature of about 425° to 650° C.; the cracking catalyst comprises aluminosilicate zeolite having an acid cracking activity less than 15.

19. A process for upgrading paraffinic naphtha to high octane fuel according to claim 18 wherein petroleum naphtha containing aromatic hydrocarbon is hydrotreated to convert aromatic components to cycloaliphatic hydrocarbons to provide fresh feedstock containing less than 5 wt% aromatics.

20. The process of claim 17 wherein fluidized bed catalyst is contacted with the feedstock in a vertical riser reactor during a short contact period which is sufficient to produce said at least 10% C4–C5 isoalkene in a transport regime and therefor, wherein said catalyst is separated from said isoalkylene and is recycled to said upgrading step; wherein said cracking reaction is carried out in the substantial absence of added hydrogen; wherein the contact period is less than 10 seconds; and wherein the space velocity is greater than 1, based on active zeolite catalyst solids.

21. A process for upgrading paraffinic naphtha to high octane fuel comprising:

contacting a fresh paraffinic petroleum naphtha feedstock stream having a normal boiling range of about 65° to 175° C. with a first fluidized bed of medium pore acid zeolite cracking catalyst under low pressure selective cracking conditions effective to produce at least 10 wt% selectivity C4–C5 isoalkene and at lest 10 wt% selectivity C4–C5 isoalkane, said cracking catalyst being substantially free of hydrogenation metal components and having an acid cracking activity less than 15;

separating cracking effluent to obtain a light olefinic fraction rich in C4–C5 isoalkene and a C6+ liquid fraction; and etherifying the C4–C5 isoalkene fraction and additional isobutene and isopentene by catalytic reaction with lower alkanol to produce tertiary-alkyl ether product.

22. A process for upgrading paraffinic naphtha to high octane fuel according to claim 21 wherein the fresh feedstock contains about C7–C10 alkanes cycloaliphatic hydrocarbons, and is substantially free of aromatics; the cracking conditions include total pressure up to about 500 kPa and reaction temperature of about 425° to 650° C.; the cracking catalyst comprises metallosilicate MCM-22 zeolite having a constraint index of about 1.5; and wherein the cracking reaction produces less than 5% C2- light gas based on fresh naphtha feedstock.

23. A process for upgrading paraffinic naphtha to high octane fuel according to claim 22 wherein the cracking catalyst comprises medium pore zeolite; the cracking reaction is maintained at about 450° to 540° C. and weight hourly space velocity of about 1 to 10; and including the additional step of recovering volatile unreacted isoalkene and alkanol from etherification effluent and contacting the volatile effluent with a second fluidized bed of medium pore acid zeolite catalyst under olefin upgrading reaction conditions to produce additional gasoline range hydrocarbons.

24. A process for upgrading paraffinic naphtha to high octane fuel according to claim 21 wherein cracking effluent is fractionated to obtain a $C_6$+ fraction, and at least a portion of the $C_6$+ fraction from cracking effluent is recycled with fresh feedstock for further conversion under cracking conditions; and wherein isobutene and isoamylene recovered from naphtha cracking are etherified with methanol to produce methyl t-butyl ether and methyl t-amyl ether.

25. A process for partially converting paraffinic naphtha feedstock olefin to branched aliphatic hydrocarbon product rich in isoalkenes and isoalkanes, which comprises contacting a feedstock containing C7–C12 naphtha range hydrocarbon with a catalyst composition under elevated temperature, short contact time partial conversion conditions to provide at least 10 wt% selectivity to isoalkene product, said catalyst comprising a synthetic porous crystalline material characterized by an X-ray diffraction pattern including values substantially as set forth in Table I of the specification.

26. The process of claim 25 wherein the synthetic porous crystalline material is characterized by an X-ray diffraction pattern including values substantially as set forth in Table II of the specification; and wherein the synthetic porous crystalline material has a composition comprising the molar relationship $$X_2O_3:(n)YO_2,$$

wherein n is at least about 10, X is a trivalent element and Y is a tetravalent element.

27. The process of claim 26 wherein the synthetic porous crystalline material has a composition comprising the molar relationship:

$$X_2O_3:(n)YO_2,$$

wherein n is at least about 10, X is a trivalent element and Y is a tetravalent element; and wherein the synthetic porous crystalline material possesses equilibrium adsorption capacities of greater than about 4.5 wt.% for cyclohexane vapor and greater than about 10 wt.% for n-hexane vapor.

28. The process according to claim 26 wherein X consists essentially of aluminum and Y consists essentially of silicon.

29. The process according claim 25, said synthetic porous crystalline material being thermally treated at a temperature up to about 925° C. in the presence or absence of steam.

30. In the process for upgrading paraffinic naphtha to high octane fuel according to claim 25 wherein the fresh feedstock contains about 15 to 50 wt% C7–C12 alkanes, about 15 to 50 wt% C7+ cycloaliphatic hydrocarbons, and less than 40% aromatics; the cracking conditions include total pressure up to about 500 kPa, space velocity greater than 1/hr WHSV, and reaction temperature of about 425° to 650° C.; the cracking catalyst comprises metallosilicate porous crystalline zeolite having a constraint index of about 1.5; and wherein the cracking reaction produces less than 5% C2-light paraffin gas based on fresh naphtha feedstock.

31. In a process for partially converting naphtha feedstock to iso-alkene rich product by shape selective catalysis at elevated temperature and low pressure, the improvement which comprises: reacting the naphtha feedstock for less than 10 seconds in contact with MCM-22 zeolite catalyst under partial reaction conditions sufficient to provide increased yield of C4–C5 isoalkanes and isoalkenes.

* * * * *

UNITED STATES PATENT AND TRADEMARK OFFICE

CERTIFICATE OF CORRECTION

PATENT NO. : 5,100,533

DATED : March 31, 1992

INVENTOR(S) : Le et al.

It is certified that error appears in the above-identified patent and that said Letters Patent is hereby corrected as shown below:

Abstract, line 6, "hydrocarbhons" should be --hydrocarbons--.

Column 19, line 48, after "low pressure" insert --fluidized bed--.

Column 22, line 8, delete "In" and replace "the" with --The--.

Signed and Sealed this

Nineteenth Day of October, 1993

Bruce Lehman

*Attest:*

BRUCE LEHMAN

*Attesting Officer*

*Commissioner of Patents and Trademarks*